US007310854B2

(12) United States Patent
Nam et al.

(10) Patent No.: US 7,310,854 B2
(45) Date of Patent: Dec. 25, 2007

(54) DUST COVER OF VACUUM CLEANER

(75) Inventors: Hyeun-Sik Nam, Seoul (KR); Byung-Do Yoo, Gyeonggi-do (KR); Heon Pyeong Ji, Busan (KR)

(73) Assignee: LG Electronics Inc., Seoul (KR)

( * ) Notice: Subject to any disclaimer, the term of this patent is extended or adjusted under 35 U.S.C. 154(b) by 551 days.

(21) Appl. No.: 10/758,201

(22) Filed: Jan. 16, 2004

(65) Prior Publication Data

US 2005/0081323 A1 Apr. 21, 2005

(30) Foreign Application Priority Data

Oct. 20, 2003 (KR) ..... 10-2003-0072996
Nov. 7, 2003 (KR) ..... 10-2003-0078760

(51) Int. Cl.
*A47L 9/14* (2006.01)

(52) U.S. Cl. ..... 15/347; 15/352; 55/373; 55/375; 55/378; 55/DIG. 3

(58) Field of Classification Search ..... 15/347, 15/350, 351, 352, 375; 55/DIG. 3, 373, 55/378, 362
See application file for complete search history.

(56) References Cited

U.S. PATENT DOCUMENTS

| | | | | |
|---|---|---|---|---|
| 1,721,459 | A * | 7/1929 | McClatchie | 15/347 |
| 4,545,794 | A * | 10/1985 | Himukai | 55/362 |
| 4,670,937 | A | 6/1987 | Sumerau et al. | 15/329 |
| 5,028,245 | A * | 7/1991 | Stein et al. | 15/350 |
| 5,755,009 | A | 5/1998 | Stephens et al. | 15/347 |
| 5,792,224 | A * | 8/1998 | Fu et al. | 55/375 |
| 6,158,080 | A * | 12/2000 | Schlapkohl | 15/352 |
| 7,069,618 | B2 * | 7/2006 | Valentini | 15/352 |

FOREIGN PATENT DOCUMENTS

| | | |
|---|---|---|
| DE | 29 04 388 A | 8/1980 |
| EP | 0 202 639 A3 | 5/1986 |

* cited by examiner

*Primary Examiner*—Theresa T. Snider
(74) *Attorney, Agent, or Firm*—Birch, Stewart, Kolasch & Birch, LLP

(57) ABSTRACT

A dust cover of a vacuum cleaner is installed to be separable from a dust collecting chamber so as to open/close the dust collecting chamber in which a dust bag filtering sucked dust is mounted, and has a support part to which the dust bag is mounted at its inside, thereby easily performing processes of mounting the dust bag to a vacuum cleaner and separating the dust bag from the vacuum cleaner and discarding without an external contamination.

26 Claims, 15 Drawing Sheets

DUST COVER OF VACUUM CLEANER

This Nonprovisional application claims priority under 35 U.S.C. § 119(a) on Patent Application No's. 10-2003-0078760 and 10-2003-0072996 both filed in KOREA on Nov. 7, 2003, and Oct. 20, 2003 the entire contents of which are hereby incorporated by reference.

BACKGROUND OF THE INVENTION

1. Field of the Invention

The present invention relates to a vacuum cleaner, and particularly to a dust cover of a vacuum cleaner capable of easily performing processes of mounting, separating and discarding a dust bag without an external contamination.

2. Description of the Background Art

In general, a vacuum cleaner is an apparatus which forcedly sucks dust and other contaminants with air from the outside by a suction force generated by a pressure difference between an external pressure and an internal pressure of a main body which is generated by a high-speed rotation of a motor having a rotation shaft at which an impeller is mounted. Recently, among such vacuum cleaners, an upright vacuum cleaner is being widely used.

As shown in FIG. 1, a vacuum cleaner according to the conventional art includes a main body 200 having a motor for generating a suction force therein; and a dust suction head 100 connected with the main body 200 through a suction duct 300, and for sucking alien substances such as dust or the like from the outside by a suction force that is generated from the motor. In addition, at an upper portion of the main body 200, a handle 220 for grip of a user is provided, and a switch 230 for switching ON/OFF the power of a vacuum cleaner and also controlling a strength of a suction force of the vacuum cleaner, is installed.

As shown in FIGS. 2A to 2C, a dirt collecting chamber 400 in which a dust bag 500 is disposed is provided inside the main body 200, and a dust cover 210 for opening/closing the dirt collecting chamber 400 is mounted at the front of the dirt collecting chamber 400. A connection duct 420 is installed inside the dust-collecting chamber 400. The connection duct 420 communicates with the suction duct 300, and is directly inserted into an opening 512 of the dust bag 500 to support the dust bag 500, and introduces air including alien substances such as dust, which has been sucked through the suction duct 300, into the dust bag 500.

FIGS. 3 and 4 illustrate a different embodiment of mounting a dust bag 500 for a conventional vacuum cleaner. As shown therein, a plate-shaped fixing plate 510 is installed around an opening of the dust bag 500, and a support part 600 pivotally connected to a fixing bracket 430 installed inside the dust collecting chamber 400 is provided. The fixing plate 510 is inserted into the support part 600, and the support part 600 is fixed to the fixing bracket 430. Accordingly, the dust bag 500 is interposed in the dust collecting chamber 400 and, at this time, its opening 512 communicates with the connection duct 420.

As shown in FIG. 4, the support part 600 includes a pair of fixing members 610 disposed so as to be isolated from each other as much as a width of the fixing plate 510 of the dust bag 500, and whose sectional shapes are formed in a rough "L" shape; and a support member 620 connecting the fixing members 610 therebetween. Inside the fixing members 610, elastic ribs 641 are provided respectively to increase a fixing force of the fixing plate 510, and stopping steps 642 for restricting an insertion position of the fixing plate 501 of the dust bag 500 are formed respectively. At the support member 620, a protrusion 650 that has a hinge shaft 651 inserted into a hinge hole 431 of the fixing bracket 430 is extended from the support member 620 so that the support part 600 is hingedly connected with the fixing bracket 430.

By the construction as above, when external power is applied to a motor installed inside a main body 200 and thus the motor is rotated, a suction force is generated at a suction head 100 by a suction force of the motor, and air including alien substances such as dust of a floor or the like is sucked through the suction head by such a suction force and is introduced into the dust bag 500 mounted inside the dust collecting chamber 400 through the suction duct 300 and the connection duct 420. The alien substances such as dust included in air which have been introduced into the dust bag 500 are filtered by the dust bag, and only purged air is discharged outside the cleaner.

A vacuum cleaner according to the conventional art constructed and operating as above is disadvantageous in that an operation of a user for mounting and detaching the dust bag 500 is complicated since the opening 512 of the dust bag 500 is directly inserted into the connection duct 420 installed inside the dust collecting chamber 400, or is interposed in the dust collecting chamber 400 through the special support part 600. In addition, in a process of detaching the dust bag 500, alien substances such as dust in the dust bag 500 flows out of the dust bag 500.

In addition, when the dust bag 500 is installed in the dust collecting chamber 400 through the support part 600, if the fixing plate 510 is not properly inserted into the support member 610 in a process of inserting the fixing plate 510 into the support member 610, the dust bag 500 can be damaged. And, when the dust bag 500 is separated from the dust collecting chamber 400, the support part 600 pivotally connected with the fixing bracket is pulled, and then, the fixing plate 510 of the dust bag 500 is pulled out from the support part 600. Thereupon, during such operations, contaminants such as dust or the like in the dust bag 500 flow out, and the user's are stained with the contaminants.

Besides, when carrying the dust bag 500 to a place of discarding after a user completely has separated the dust bag 500 from the vacuum cleaner, alien substances in the dust bag 500 flow out through the opening 512 of the dust bag 500.

SUMMARY OF THE INVENTION

Therefore, an object of the present invention is to provide a dust cover of a vacuum cleaner capable of easily mounting a dust bag and capable of easily separating and discarding the dust bag without an external contamination, by mounting a dust bag to a dust cover opening/closing a dust collecting chamber of a vacuum cleaner.

To achieve these and other advantages and in accordance with the purpose of the present invention, as embodied and broadly described herein, there is provided a dust cover of a vacuum cleaner, which is installed to be separable from a dust collecting chamber so as to open/close the dust collecting chamber in which a dust bag filtering sucked dust is mounted, and having an inner portion provided with a support part to which the dust bag is mounted.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
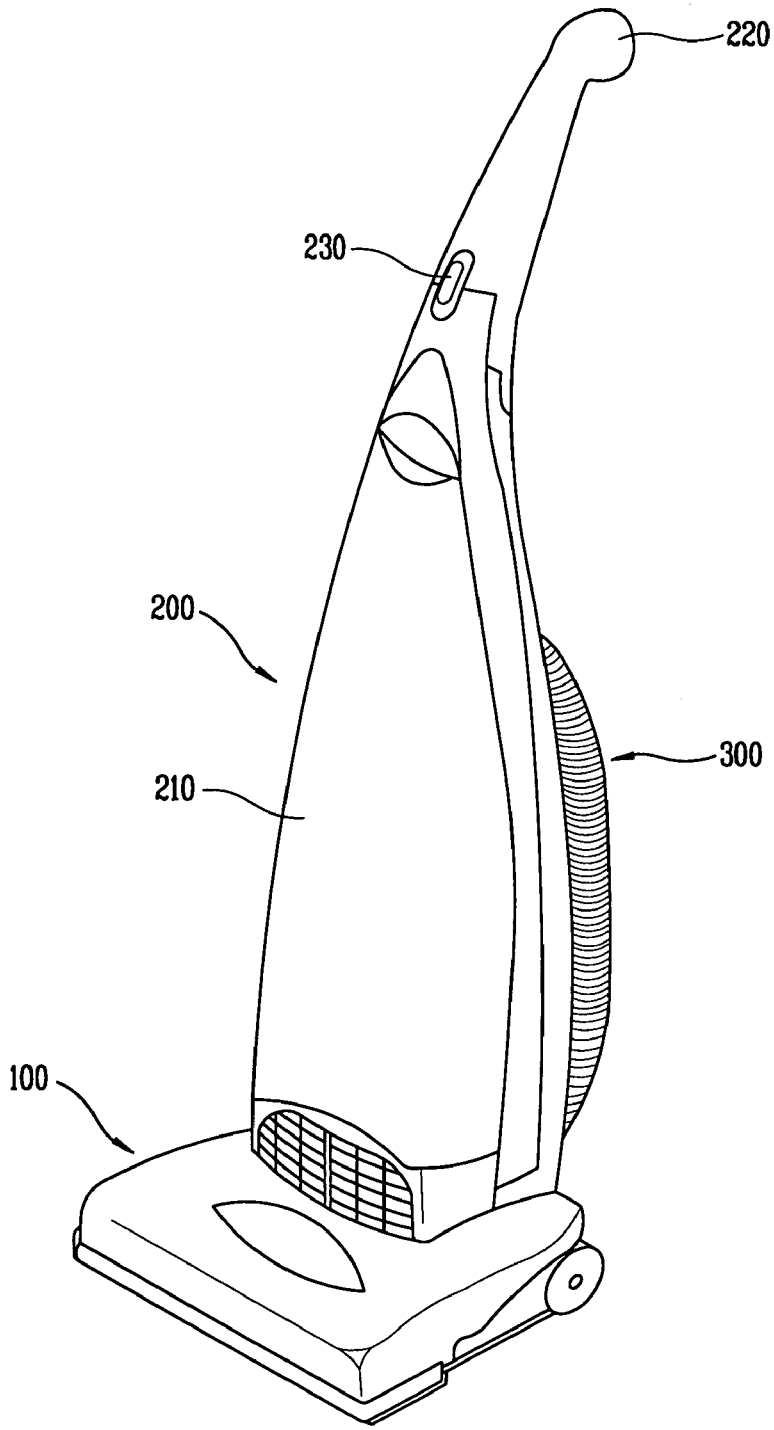
FIG. 1 CONVENTIONAL ART
FIG. 1 is a perspective view illustrating one example of a general vacuum cleaner.
Figure 2A:
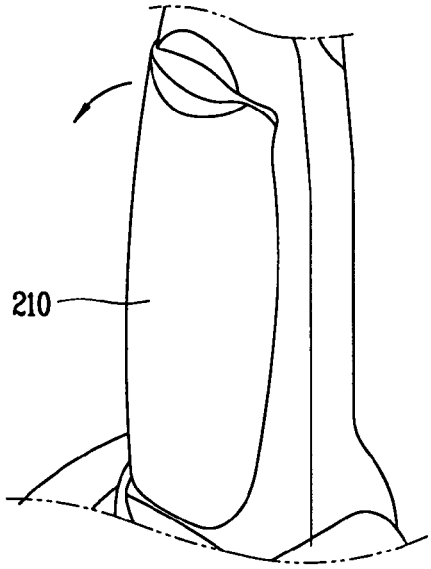
FIG. 2A CONVENTIONAL ART
FIGS. 2A to 2C are partial perspective views illustrating a dust cover, a dust collecting chamber and a dust bag which are provided for a vacuum cleaner according to the conventional art.
Figure 2B:
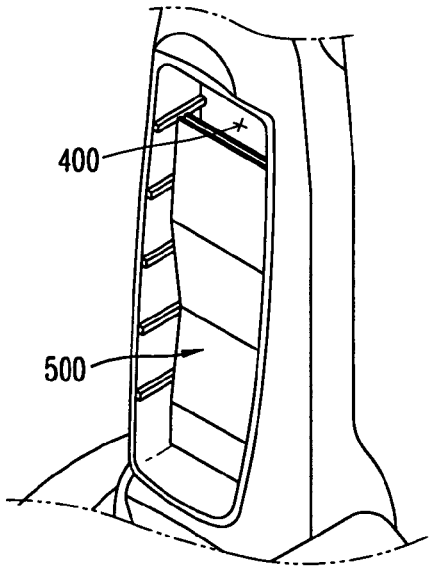
FIG. 2B CONVENTIONAL ART
Figure 2C:
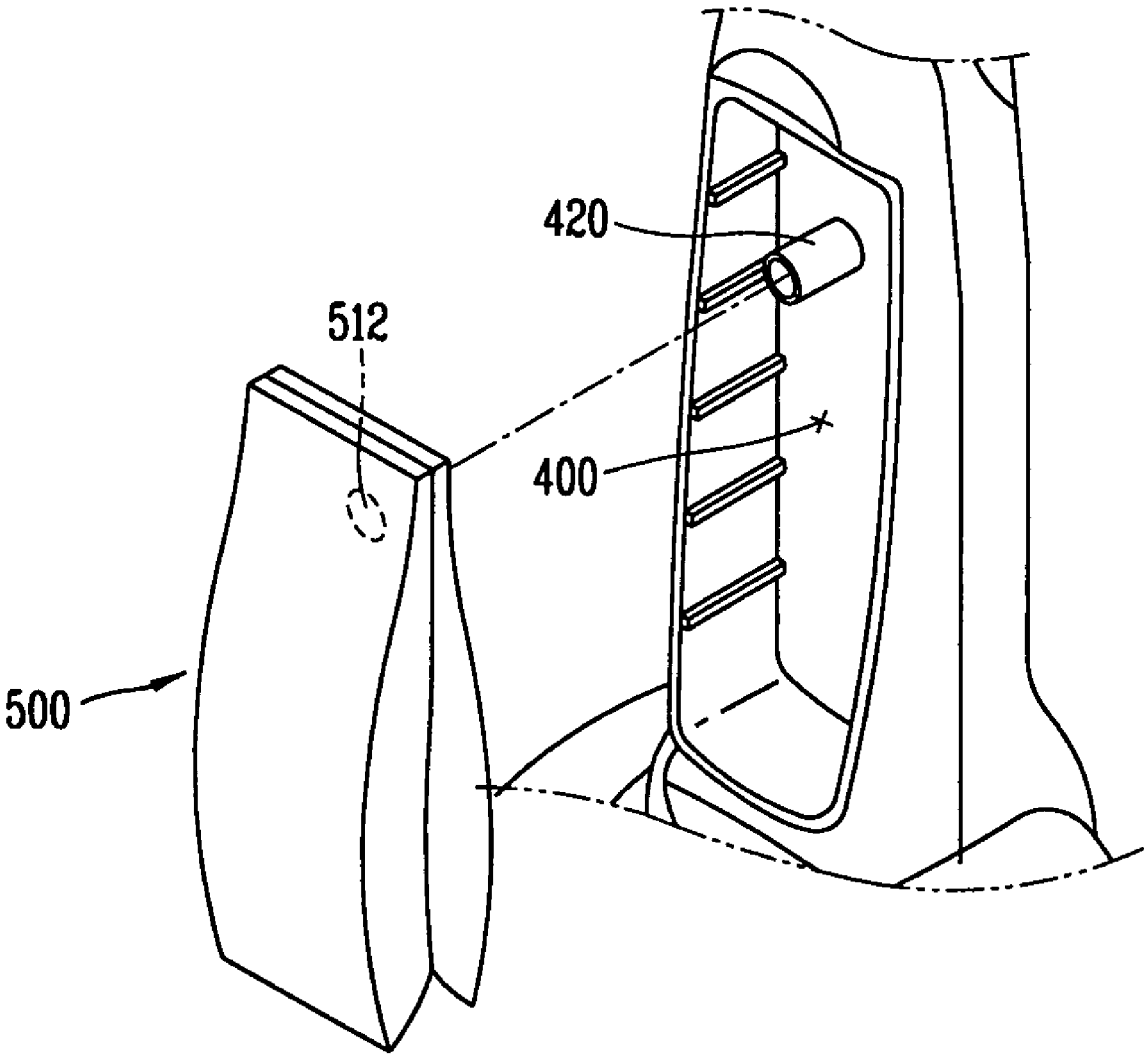
FIG. 2C CONVENTIONAL ART
Figure 3:
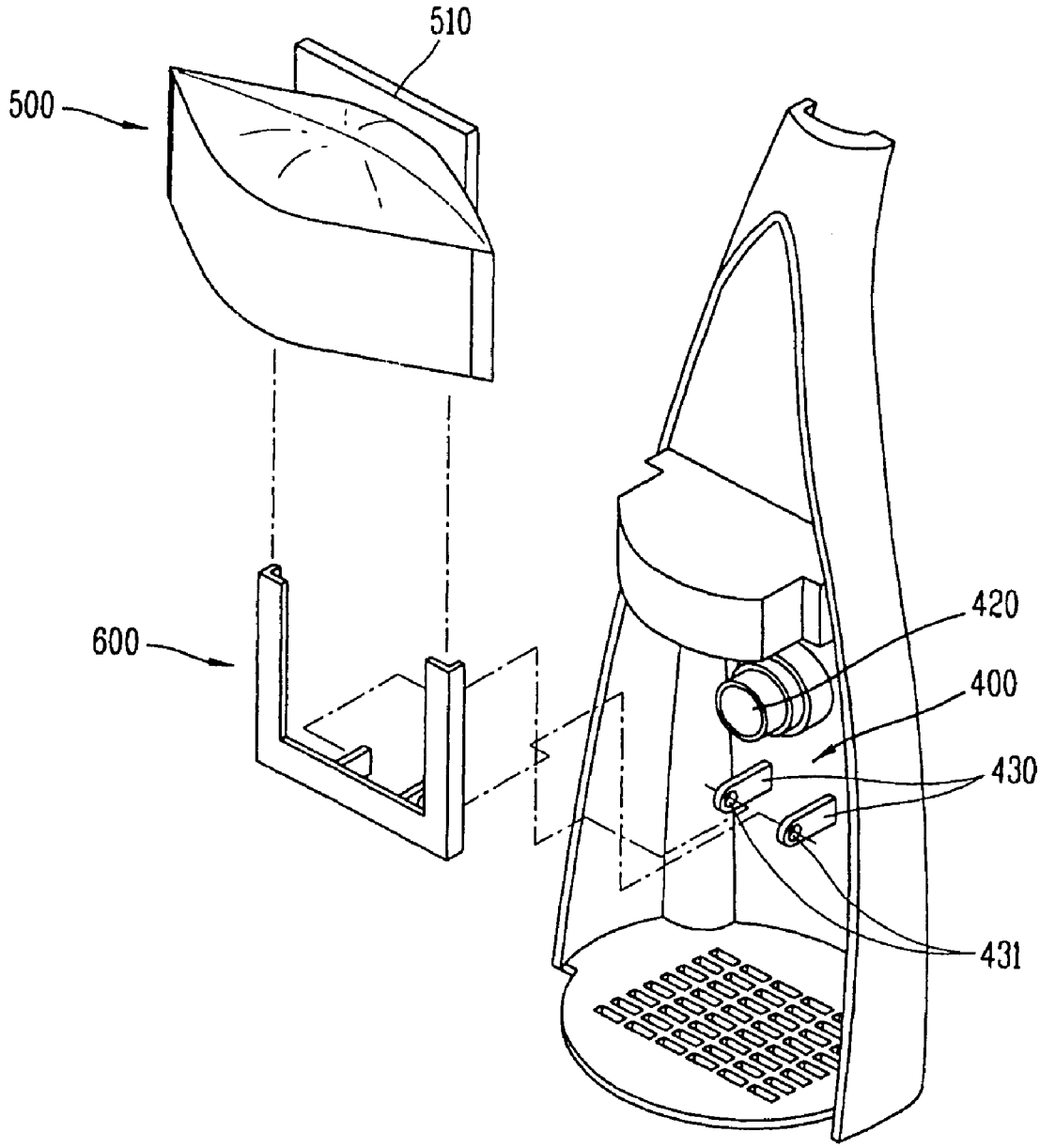
FIG. 3 CONVENTIONAL ART
FIG. 3 is a partial perspective view illustrating a dust bag and a dust collecting chamber provided for a vacuum cleaner according to the conventional art.
Figure 4:
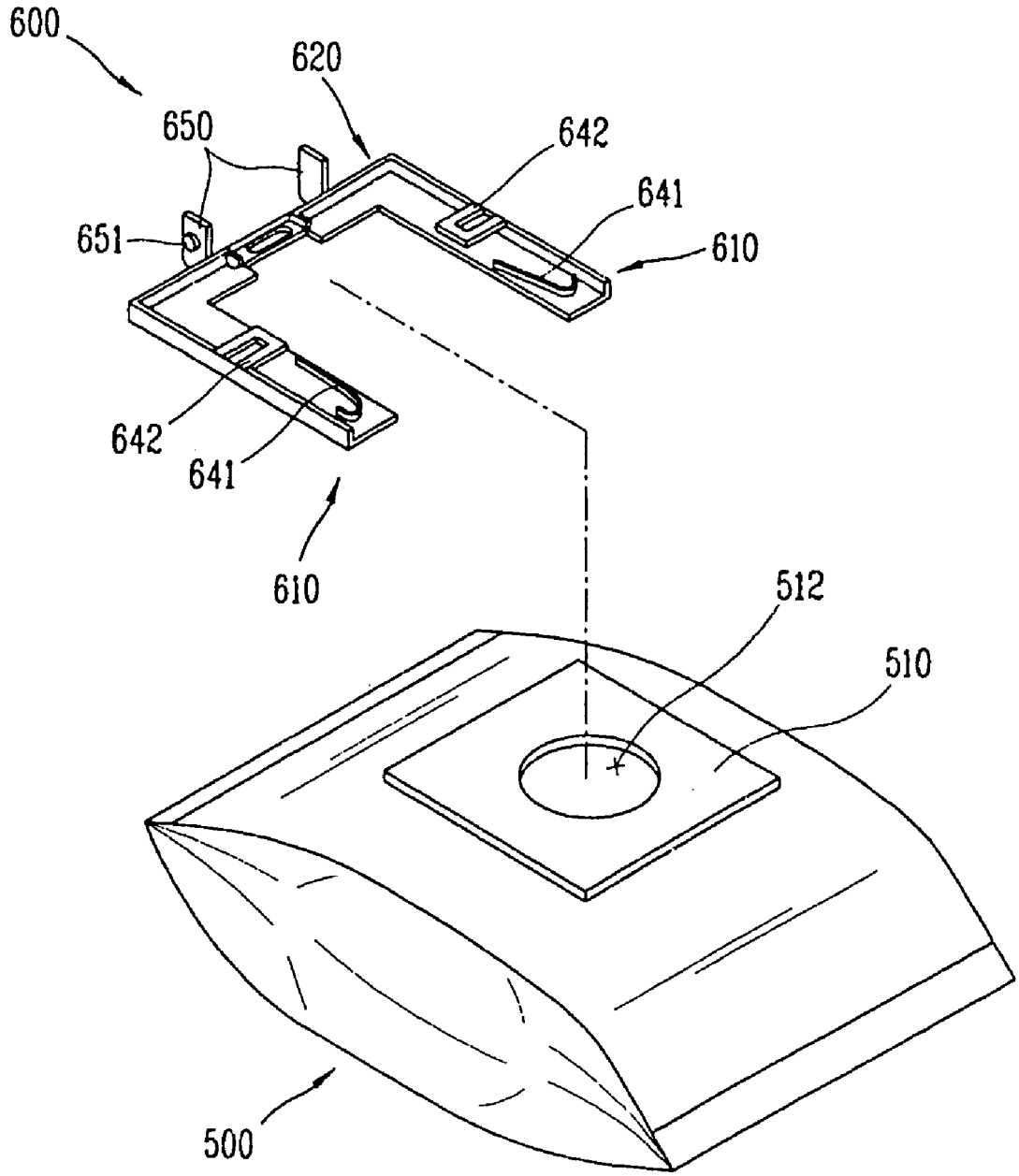
FIG. 4 CONVENTIONAL ART
FIG. 4 is a perspective view illustrating a support part for supporting a dust bag so that the dust bag is fixed to a dust collecting chamber provided for a vacuum cleaner according to the conventional art.
Figure 5:
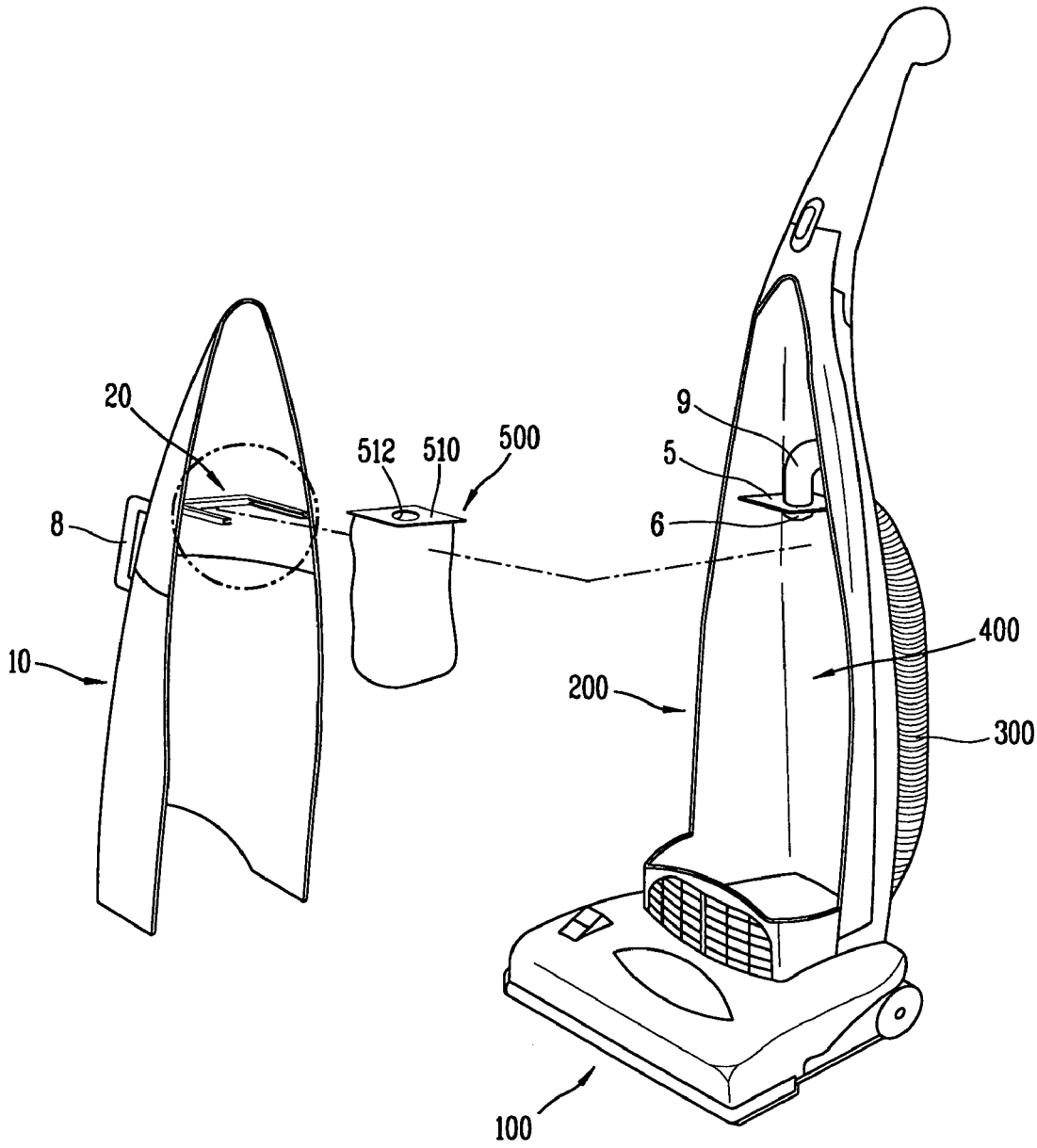
FIG. 5 is a perspective view illustrating a disassembled vacuum cleaner according to a first embodiment of the present invention.
Figure 6:
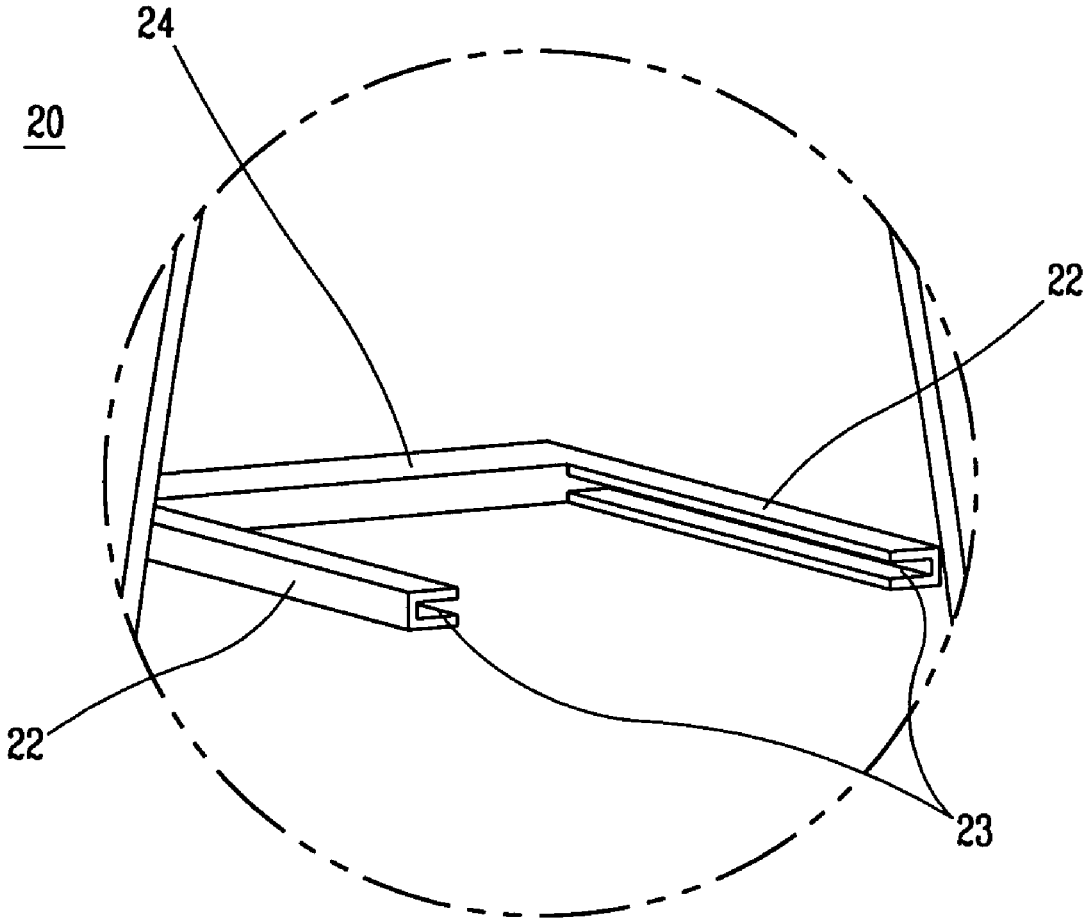
FIG. 6 is a magnified view of a main portion of FIG. 5.

As shown in FIGS. 5 and 6, a vacuum cleaner according to a first embodiment of the present invention includes a main body 200 having a motor (not shown) for generating a suction force therein; and a dust suction head 100 connected with the main body 200 through a suction duct 300, and sucking alien substances such as dust or the like from the outside by a suction force generated from the motor.

At the main body 200, there is provided a dust collecting chamber 400 at which a connection duct 9 communicating with the suction duct 300 is installed, and in which a dust bag 500 filtering sucked dust is mounted; and a dust cover 10 separably installed at the front of the dust collecting chamber 400 so as to open/close the dust collecting chamber 400, and having a support part 20 coupled with and supporting the dust bag 500 therein.

A support plate 5 for supporting a plate-shaped-fixing plate 510 fixed to an opening 512 of the dust bag 500 is installed toward an outlet of the connection duct 9, and a duct connector 6 which is inserted into the opening 512 of the dust bag 500 in interposing the dust bag 500 is installed at one side of the support plate 5. Herein, preferably, the duct connector 6 is formed of an elastic material such as resin or the like which can be elastically deformed so as to be easily inserted into the opening 512 of the dust bag 500 in an ingression of the dust bag 500.

The support part 20 includes a pair of fixing members 22 disposed inside the dust cover 10 at an interval as much as a width of a fixing plate of the dust bag 500 therebetween, and having a groove 23 formed at an inner side, having a thickness as much as a thickness of the fixing plate 510 so that the fixing plate 510 is inserted thereinto; and a support member 24 disposed between the pair of fixing members 22, supporting the fixing members 22, and setting an insertion position of the fixing plate 510.

Preferably, at the outer surface of the dust cover 10, a handle 8 is installed so that a user can easily carry the dust cover 10.

Processes of mounting and detaching a dust bag in a vacuum cleaner according to the first embodiment of the present invention constructed as above will now be described.

In case of mounting the dust bag 500 inside the vacuum cleaner, first, a user separates the dust cover 10 from the main body 200 of the vacuum cleaner, and inserts the fixing plate 510 of the dust bag 500 into the groove 23 of the fixing member 22. Then, when the dust cover 10 is mounted to the main body 200, the duct connector 6 connected with the connection duct 9 is inserted into the opening 512 of the dust bag 500, thereby finishing the process of mounting the dust bag 500. At this time, since the duct connector 6 is formed of an elastic material, the duct connector 6 moves to a predetermined position in an ingression of the dust bag 500, and then returns to an initial position, inserted into the opening 512 of the dust bag 500.

In addition, in case of separating the dust bag 500 from the vacuum cleaner and discarding the dust bag 500, a user separates the dust cover 10 from the main body 200 of the vacuum cleaner, moves the dust cover 10 to a place of discarding the dust bag 500, and then pulls out the fixing plate 510 of the dust bag 500 from the fixing member 22 of the support part to discard the dust bag 500, thereby finishing the process of separating and discarding the dust bag 500.

In the vacuum cleaner according to the first embodiment of the present invention as above, the dust bag 500 filtering alien substances such a dust is simply inserted in the dust cover 10, whereby a user can simply mount/separate the dust bag 500 to/from the vacuum cleaner without an external contamination.

In addition, the dust bag 500 can be carried to a place of discarding in a state that the dust bag 500 is mounted to the dust cover 100, thereby easily performing a process of separating and discarding the dust bag 500 without an external contamination.

Figure 7:
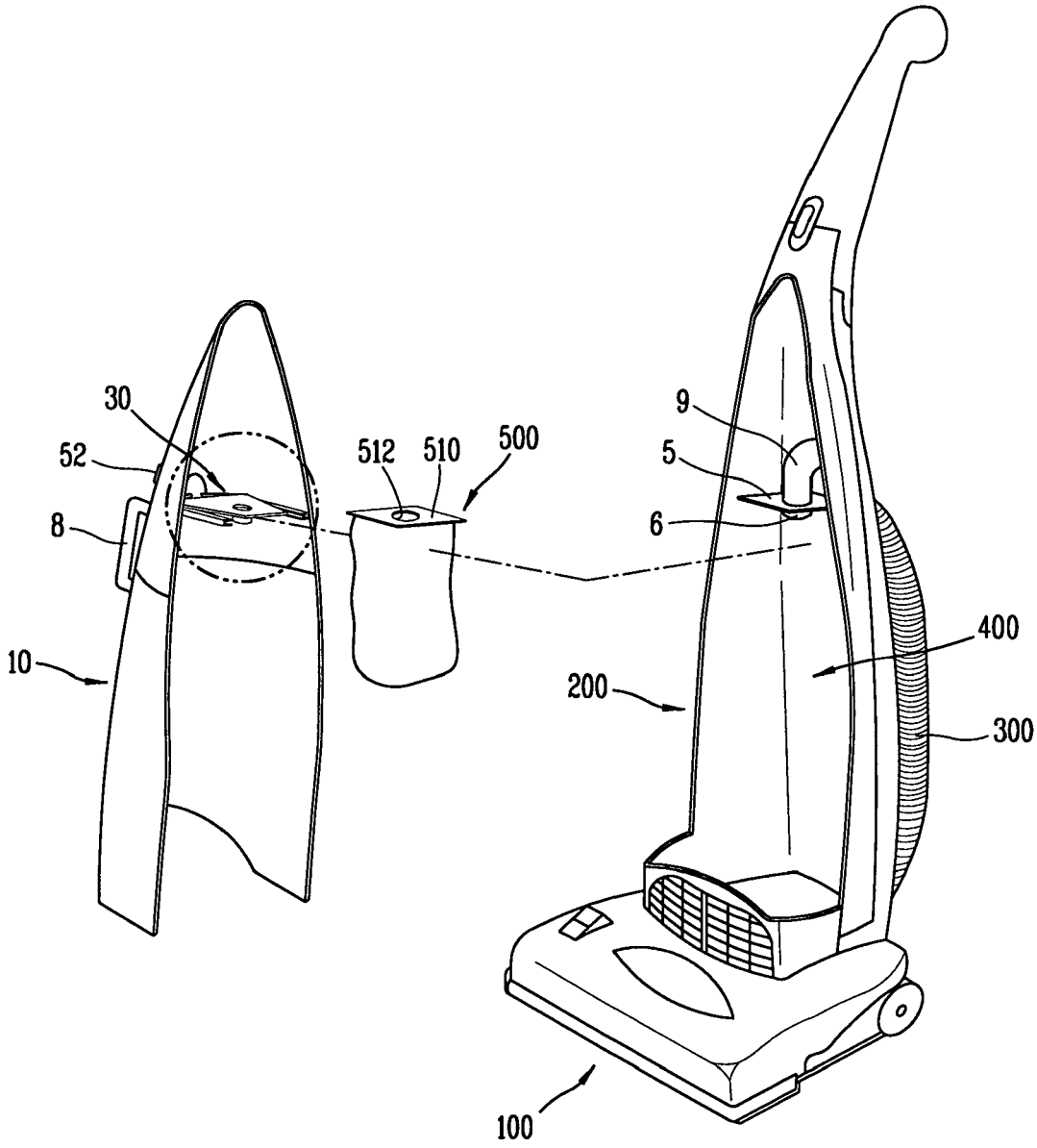
FIG. 7 is a perspective view illustrating a disassembled vacuum cleaner according to a second embodiment of the present invention.

As shown in FIG. 7, a vacuum cleaner according to a second embodiment of the present invention includes the main body 200 having a motor for generating a suction force therein; and the dust suction head 100 connected with the main body 200 through the suction duct 300, and sucking alien substances such as dust or the like from the outside by the suction force generated from the motor.

At the main body 200, there are provided the dust collecting chamber 400 at which the connection duct 9 communicating with the suction duct 300 is installed, and in which the dust bag 500 filtering sucked dust is mounted; and the dust cover 10 separably installed at the front of the dust collecting chamber 400 so as to open/close the dust collecting chamber 400, and having a support part 30 coupled with and supporting the dust bag 500 therein.

The support plate 5 for supporting the plate-shaped fixing plate 510 fixed to the opening 512 of the dust bag 500 is installed toward an outlet of the connection duct 9, and the duct connector 6 which is inserted into the opening 512 of the dust bag 500 in interposing the dust bag 500 is installed at one side of the support plate 5. Herein, preferably, the duct connector 6 is formed of an elastic material such as resin or the like which can be elastically deformed so as to be easily inserted into the opening 512 of the dust bag 500 in an ingression of the dust bag 500.

The support part 30 includes a pair of fixing members 32 disposed inside the dust cover 10 at an interval as much as a width of the fixing plate 510 of the dust bag 500 therebetween, having one end pivotally installed at a hinge shaft 34 fixed to the dust cover 10, and having a groove 33 formed at an inner side, into which both sides of the fixing plate 510 of the dust bag 500 are inserted; a guide unit 40 installed at a position adjacent to the fixing member 32 in the dust cover 10, and for guiding an installation position of the dust bag 500; and a separating unit 50 (see FIGS. 9A and 9B) for separating the dust bag 500 from the dust cover 10.

Figure 8:
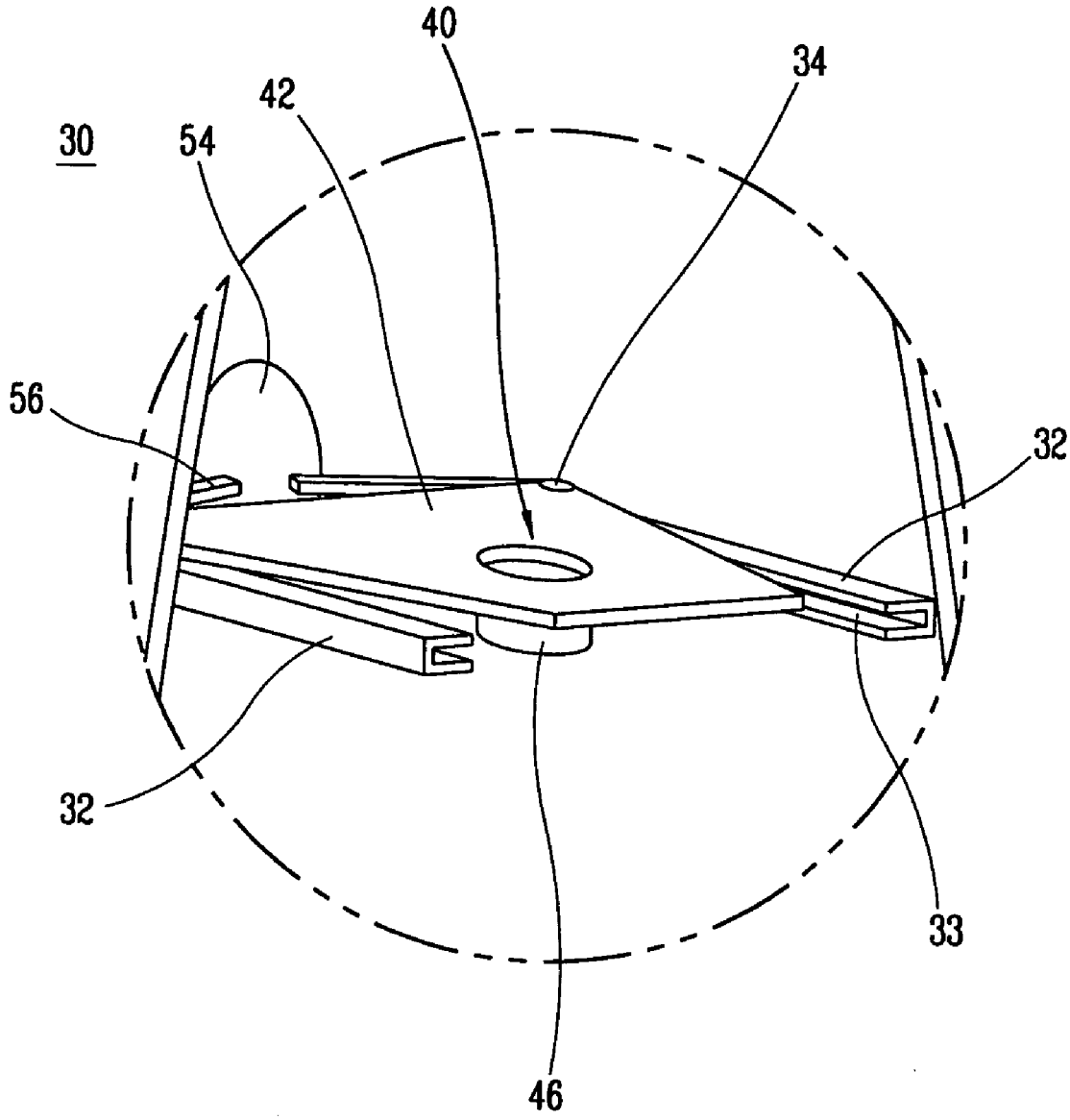
FIG. 8 is a magnified view of a main portion of FIG. 7.

As shown in FIG. 8, the guide unit 40 includes a plate-shaped guide panel 42 fixed to an inner side of the dust cover 10, and having a through hole 44 therein; and a guide duct 46 extended from the through hole 44 toward a direction of mounting the dust bag 500, and inserted into an opening 512 of the dust bag 500 when the dust bag 500 is fixed to the fixing member 32. The through hole 44 of the guide panel 42 communicates with the duct connector 6 when the dust cover is mounted to the vacuum cleaner. Herein, preferably, the guide duct 46 is formed of an elastic material such as resin or the like which can be elastically deformed so as to be easily inserted into the opening 512 of the dust bag 500. The guide panel 42 is fixed to an inner side of the dust cover 10 in a state that a position where the through hole 44 and the duct connector 6 communicate with each other has been preset, and the guide duct 46 is directly inserted into the opening 512 of the dust bag 500, thereby preventing a problem that the opening 512 of the dust bag 500 and the duct connector 6 do not properly communicate with each other from occurring.

Figure 9A:
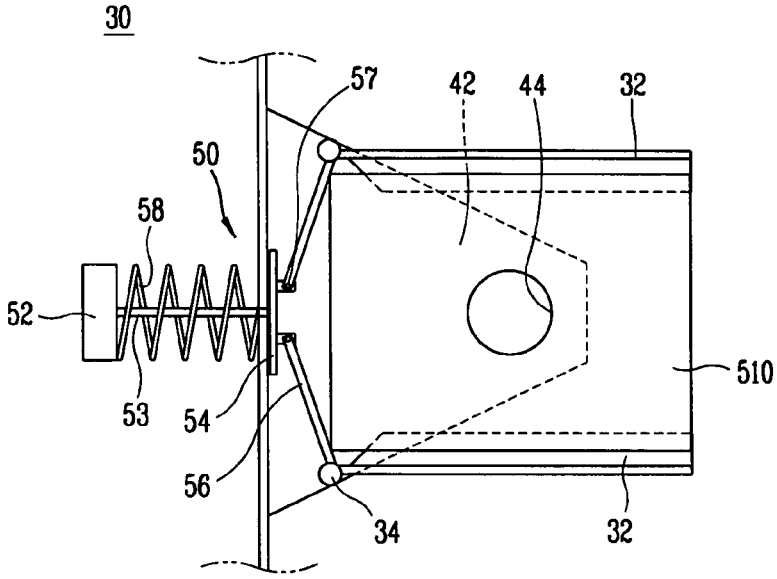
FIGS. 9A and 9B are view showing a state of operating a support part of a dust bag and a separating unit provided for a vacuum cleaner according to a second embodiment of the present invention.
Figure 9B:
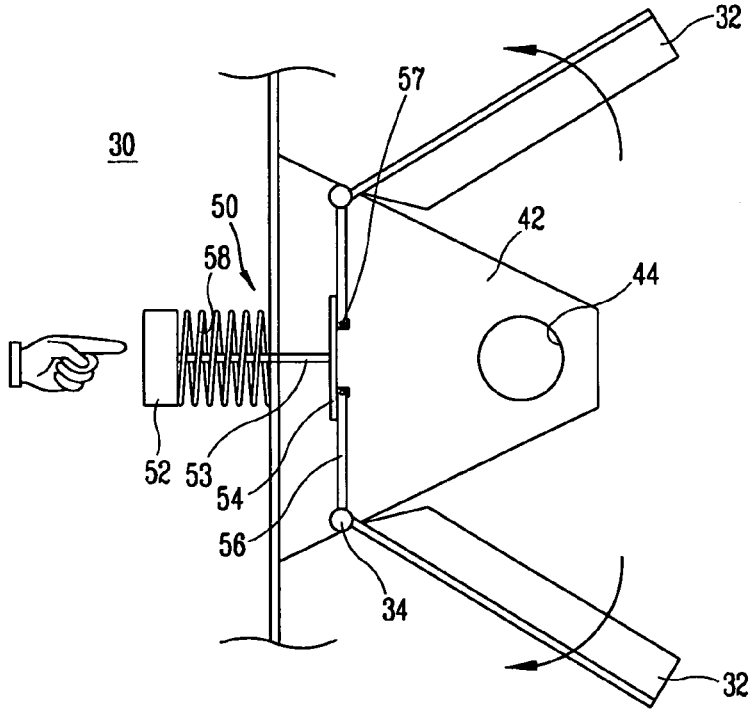

As shown in FIGS. 9A and 9B, the separating unit 50 includes a connecting links 56 formed near the hinge shafts 34 at a predetermined angle to the pair of fixing members 32 respectively, and integrally extended from the fixing members 32; a pressing member 54 connected with the connecting link 56 by the hinge shaft 57, and pushing the connecting links 56 to rotate the pair of fixing members 32 in directions that the fixing members 32 are far away from each other; a button 52 connected with the pressing member 54 by a connecting rod 53, protruded to the outside of the dust cover 10, and receiving an external force for moving the pressing member 54; and an elastic member 58 disposed between the button 52 and the dust cover 10, and returning the button 52 and the fixing member 32 to initial positions in releasing the button 52.

Preferably, at an outer surface of the dust cover 10, the handle 8 is installed so that a user can easily carry the dust cover 10.

Processes of mounting and separating a dust bag in a vacuum cleaner according to the second embodiment of the present invention constructed as above will now be described.

When of mounting the dust bag 500 inside the vacuum cleaner, first a user separates the dust cover 10 from the main body 200 of the vacuum cleaner, applies an external force to the button 52, so that the pressing member 54 connected with the button 52 through the connecting rod 53 pushes the connecting link 56. Accordingly, as shown in FIG. 9B, the fixing members 32 are opened widely toward both sides. And, if the button 52 is released in a state that an guide duct 46 of the guide unit 40 has been inserted into an opening of the dust bag 500, as shown in FIG. 9A, the button 52 and the fixing members 32 return to their initial positions by the elastic member 58. At this time, both sides of the fixing plate 510 of the dust bag 500 are inserted into the groove 33 of the fixing member 32 to be coupled to the fixing member 32. Then, when the dust cover 10 is mounted to the main body 200, the duct connector 6 connected with the connection duct 9 is inserted into the through hole 44 of the guide panel 42, thereby terminating the process of mounting the dust cover 500. At this time, the duct connector 6 is formed of an elastic material, so that the duct connector 6 moves to a predetermined position in an ingression of the guide panel 42 and returns to an initial position to be inserted into the opening 512 of the dust bag 500.

In addition, when separating the dust bag 500 from the vacuum cleaner and discarding, a user separates the dust cover 10 from the main body 200 of the vacuum cleaner, moves the dust cover 10 to a position of discarding the dust bag 500, and then applies an external force to the button 52. Thus, as shown in FIG. 9B, the pressing member 54 pushes the connecting link 56 to widely open the fixing members 32 toward both sides. At this time, both sides of the fixing plate 510 of the dust bag 500 slip out from the groove 33 of the fixing member 32, and thus the dust bag 500 falls off by self-weight, thereby finishing the process of separating and discarding.

In the vacuum cleaner according to the second embodiment of the present invention as above, the dust bag 500 filtering alien substances such as dust or the like is simply installed at the dust cover 10, whereby a user can easily mount the dust bag 500 to the vacuum cleaner, and can separate and discard the dust bag 500 without an external contamination.

In addition, the guide unit 40 for guiding an installation position of the dust bag 500 is provided, whereby the dust bag 500 and the duct connector 6 can properly communicate with each other without a problem.

Besides, because the separating unit 50 for separating the dust bag 500 is provided, a user has no need to remove the dust bag 500 at firsthand in discarding the dust bag 500, thereby preventing a problem that the user's hand is stained with contaminants in removing the dust bag 500.

Figure 10:
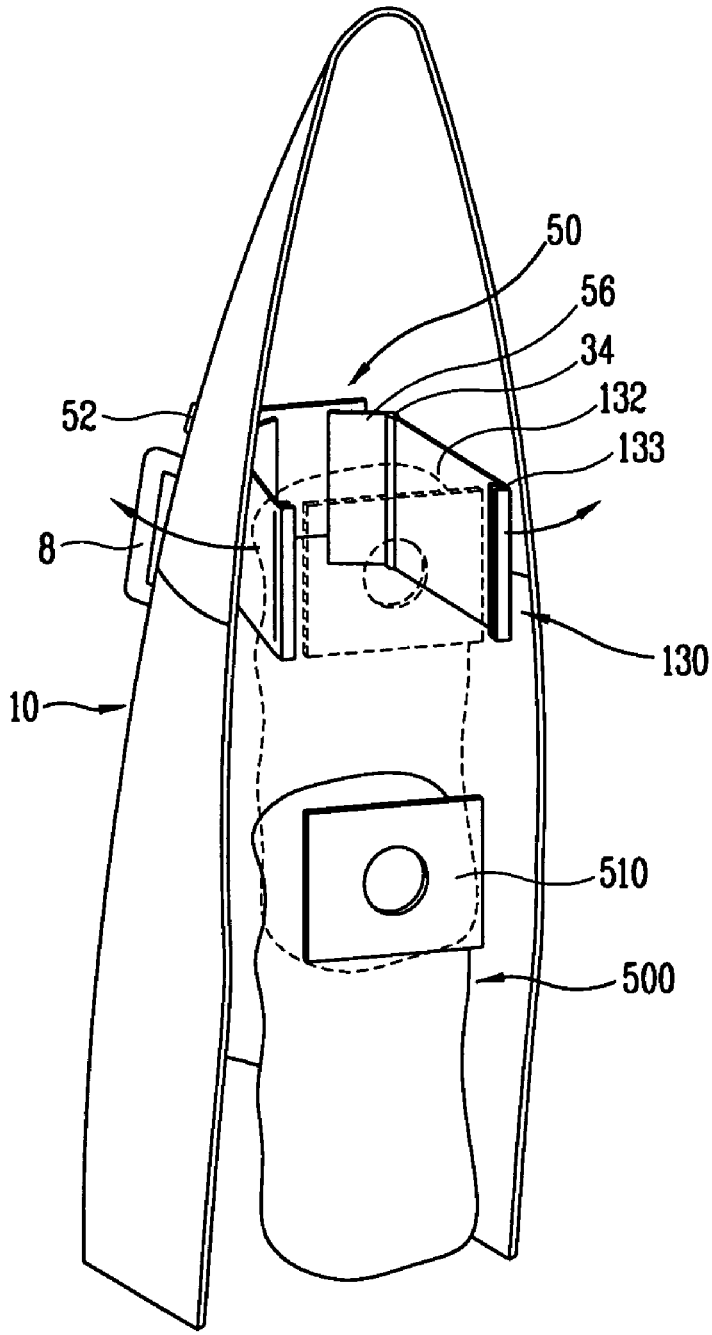
FIG. 10 is a perspective view illustrating a dust cover of a vacuum cleaner according to a third embodiment of the present invention.

A vacuum cleaner according to a third embodiment of the present invention will now be described with reference to FIG. 10. Hereinafter, the same numerals will be given to the same parts as those in abovementioned embodiments and explanations thereof will be omitted.

The vacuum cleaner according to the third embodiment of the present invention is similar to the abovementioned second embodiment. But, in the vacuum cleaner according to the third embodiment, a groove 133 formed in a fixing member 132 of a support part 130 provided in the dust cover 10 is formed to be vertically long. A fixing plate of the dust bag 500 is fixed thereto in a state of having been inserted into the groove 133, and the fixing plate 510 is not separated from the groove 133 by an elastic force of the abovementioned elastic member 58.

In the vacuum cleaner according to the third embodiment of the present invention, processes of mounting and separating the dust bag 500 and effect of the invention are the same as those explained in the abovementioned embodiments.

Figure 11:
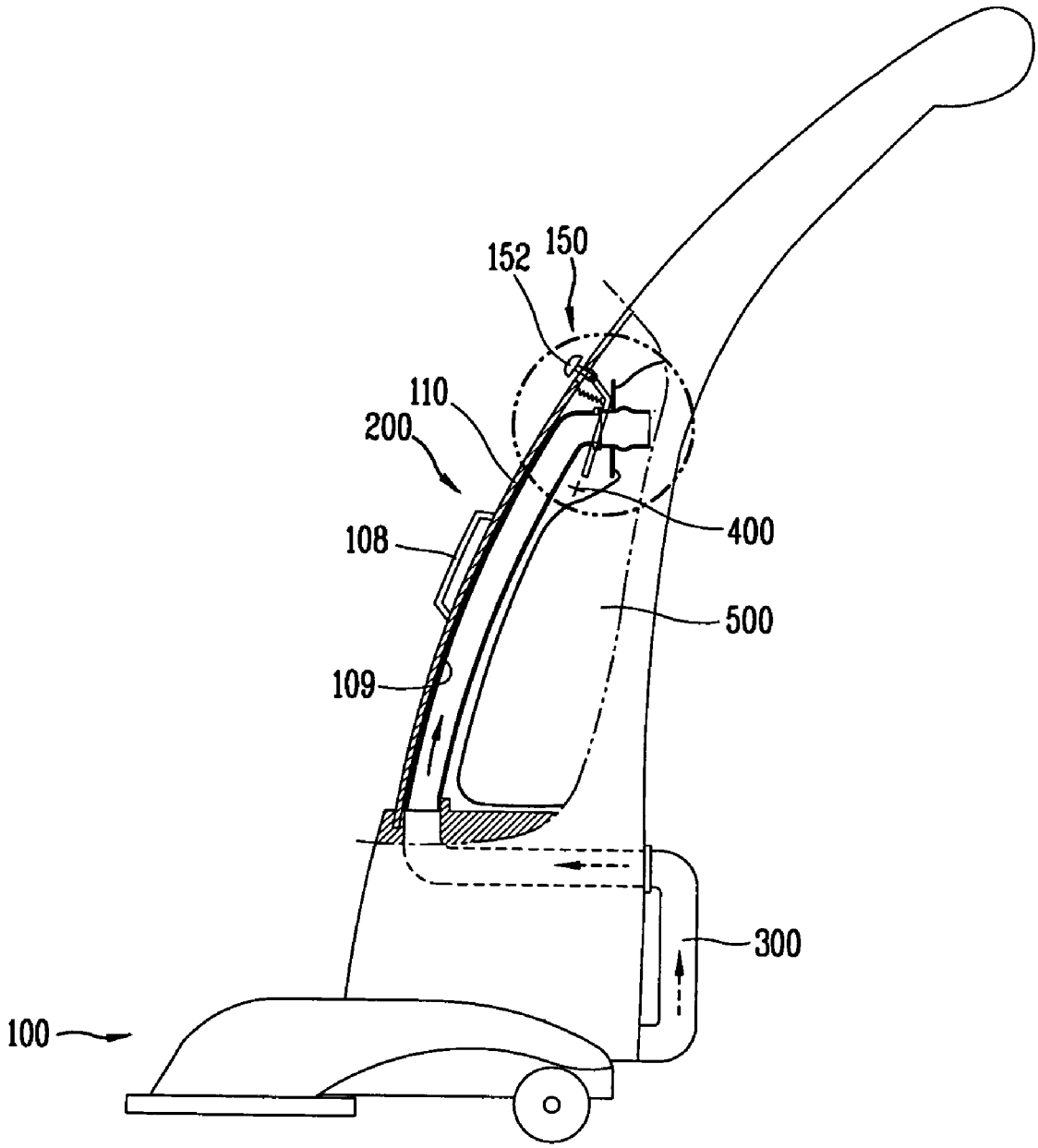
FIG. 11 is a partial sectional view illustrating a vacuum cleaner according to a fourth embodiment of the present invention.
Figure 12:
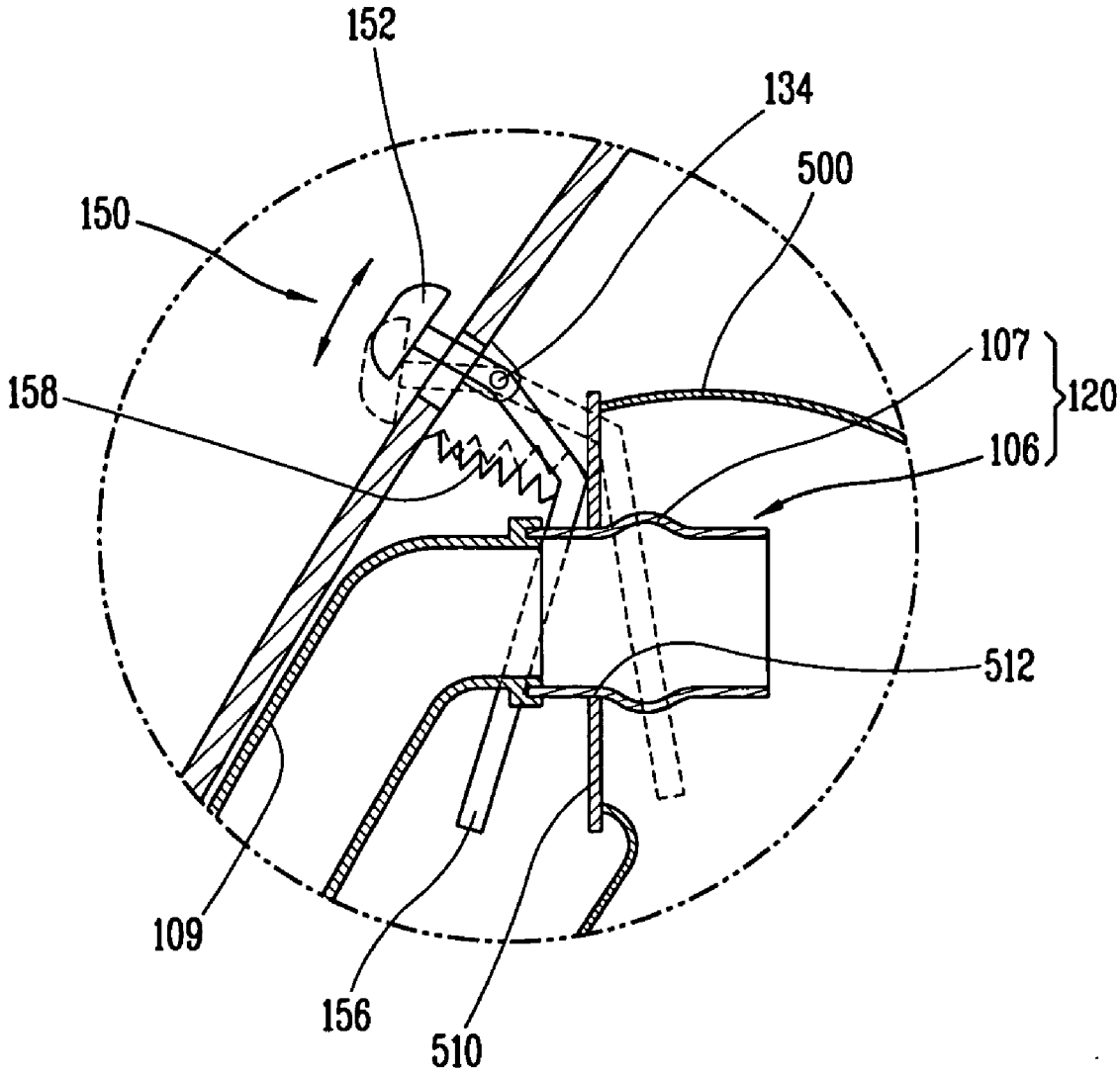
FIG. 12 is a magnified view of a main portion of FIG. 11.

As shown in FIGS. 11 and 12, a vacuum cleaner according to a fourth embodiment of the present invention includes the main body 200 having a motor for generating a suction force therein; and the dust suction head 100 connected with the main body 200 through the suction duct 300, and sucking alien substances such as dust or the like from the outside by a suction force generated from the motor.

At the main body, there are provided the dust collecting chamber 400 in which the dust bag 500 filtering sucked dust is mounted; and a dust cover 110 separably installed at the front of the dust collecting chamber 400 so as to open/close the dust collecting chamber 400.

The dust cover 110 is provided with a connection duct 109 communicating with the suction duct 300; a support part 120 coupled with and supporting the dust bag 500; and a separating unit 150 for separating the dust bag 500 from the dust cover.

The connection duct 109 is integrally fixed to the inside of the dust cover 110, and is inserted into an outlet of the suction duct 300 continued to the inside of the main body 200 when the dust cover 110 is mounted to the vacuum cleaner. Preferably, the dust cover 110 and the connection duct 109 are formed of a transparent material so that a user can observe a state of sucking dust with the naked eye.

The supporting unit 120 is composed of a tubular duct connector 106 fixed toward an outlet of the connection duct 109, formed of an elastic material such as resin having an elastic force, and having a support step 107 protruded at the middle thereof in a radial direction. Since the duct connector 106 is formed of an elastic material, when the opening 512 of the dust bag 500 is inserted thereinto, the support step 107 is depressed by a force of inserting the dust bag 500. After the opening 512 has been completely inserted thereinto, the support step 107 returns to an initial state, so that the opening 512 is not released from the duct connector 106.

The separating unit 150 includes a lever 156; and a knob 152 mounted at one end of the lever 156, and to which an external force is applied by a user. Herein, one end of the lever 156 is protruded to the outside of the dust cover 110, its middle portion is bent, and the bent portion is hingedly connected to the dust cover 110 by a hinge shaft fixed to the dust cover 110. Also, the other end of the lever 156 is positioned at the front of the dust bag 500.

Figure 13:
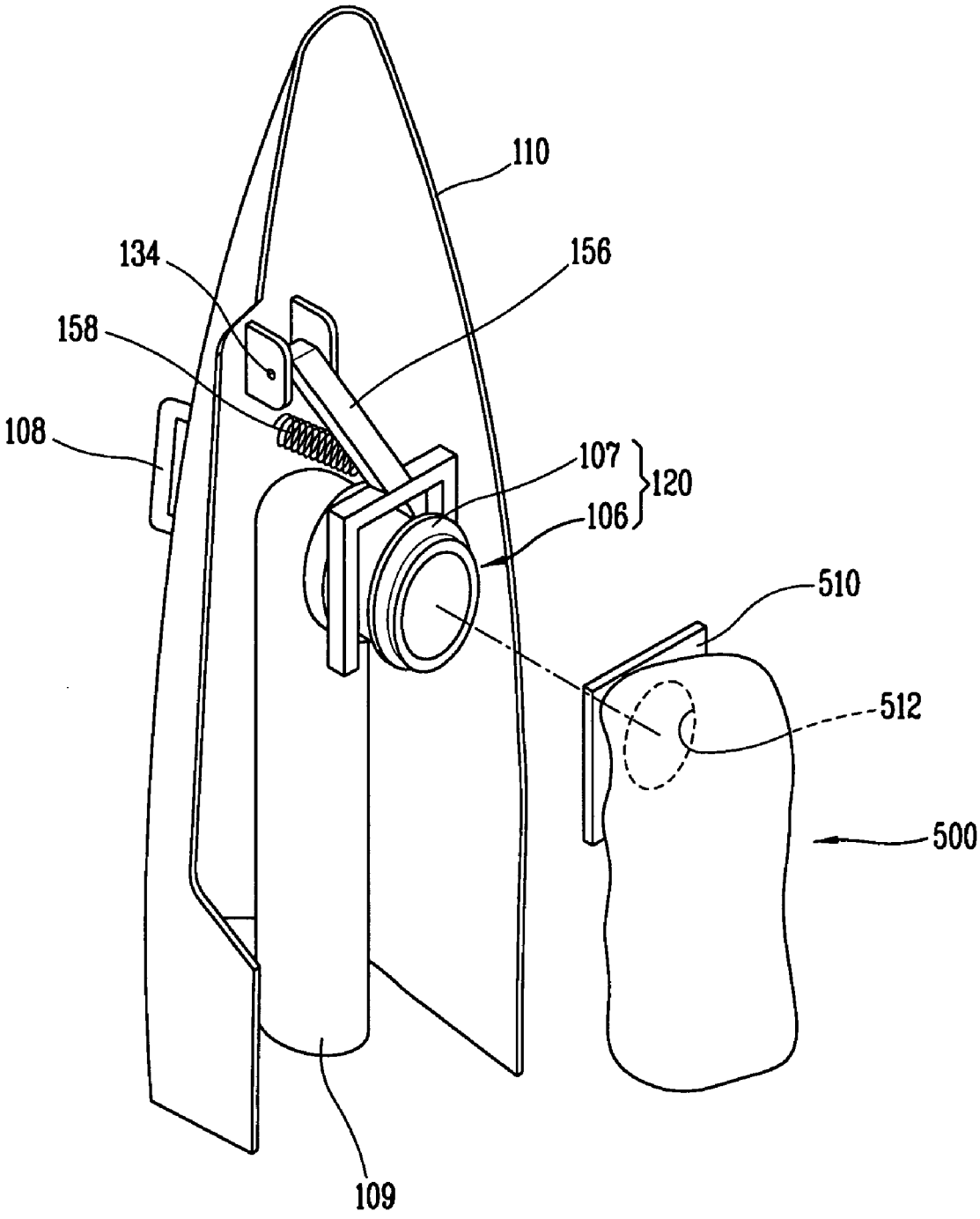
FIG. 13 is a perspective view illustrating a dust cover of a vacuum cleaner according to a fourth embodiment of the present invention.

As shown in FIG. 13, the other end of the lever 156 is divided at a position adjacent to the duct connector 106 as much as a width of the fixing plate 510, so that the dust bag 500 can be more effectively removed.

Figure 14A:
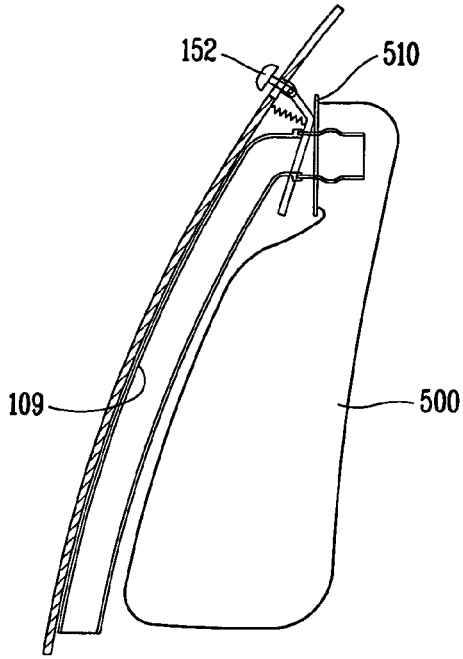
FIGS. 14A and 14B are views showing a process of separating a dust bag from a dust cover of a vacuum cleaner according to a fourth embodiment of the present invention.
Figure 14B:
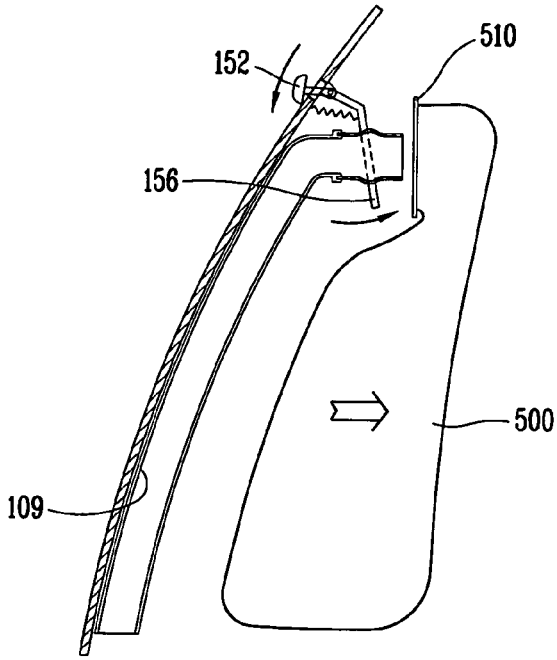

As shown in FIGS. 14A and 14B, in the separating unit 150, when an external force is transmitted to the knob 152 (downward on the drawing), the lever 156 is rotated centering on the hinge shaft 134, and thus the other end of the lever 156 pushes a fixing plate 510 of the dust bag 500 to separate the dust bag 500 from the duct connector 106. When the dust bag 500 is inserted thereinto, the knob 152 and the lever 156 can return to initial positions by being pushed by the fixing plate 510 of the dust bag 500. Besides, by installing an elastic member 158 between the lever 156 and the dust cover 110, the lever 156 and the knob 152 can return to initial positions automatically by the elastic member 158 in releasing the lever 156.

Preferably, a handle 108 is installed at an outer surface of the dust cover 110 so that a user can easily carry the dust cover 110.

Processes of mounting and separating a dust bag in a vacuum cleaner according to the fourth embodiment of the present invention constructed as above will now be described.

When mounting the dust bag 500 inside the vacuum cleaner, first, a user separates the dust cover 110 from a main body 200 of the vacuum cleaner, and inserts an opening 512 of the dust bag 500 into the duct connector 106. Then, the dust cover 110 is mounted to the main body 200, thereby finishing the process of mounting the dust bag 500. At this time, the connection duct 109 is inserted into an outlet of the suction duct 300 to communicate with the suction duct.

In addition, when separating the dust bag 500 from the vacuum cleaner and discarding the dust bag 500, a user separates the dust cover 110 from the main body 200 of the vacuum cleaner, moves the dust cover 110 to a place of discarding the dust bag 500, and then applies an external force to the knob 152. Then, the lever 156 rotates centering on the hinge shaft 134, and thus, the other end of the lever 156 pushes the fixing plate 510 of the dust bag 500, so that the dust bag 500 falls off by self-weight, thereby terminating the process of separating and disposing.

In the vacuum cleaner according to the fourth embodiment of the present invention, because the dust bag 500 filtering alien substances such as dust is simply installed to the dust cover 110, a user can easily mount the dust bag 500 to the vacuum cleaner, and can separate and discard the dust bag 500 without an external contamination. In addition, because the separating unit 150 for separating the dust bag 500 is provided, a user has no need to manually remove the dust bag 500 thereby preventing a problem that the user's hand is stained with alien substances such as dust in removing the dust bag 500.

In addition, in the vacuum cleaner according to the fourth embodiment of the present invention, the connection duct 106 which is connected with the suction duct 300 is integrally fixed to the dust cover 110, and the dust bag 500 is directly coupled and supported toward the outlet of the connection duct. Accordingly, unlike the conventional art, the process of coupling the dust bag 500 to the dust cover 110 and then fitting an opening 512 of the dust bag 500 to the outlet of the connection duct 106 is omitted, thereby further simplifying a process of mounting the dust bag 500.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A dust cover of a vacuum cleaner, comprising:

a support part installed on an inner surface of a dust cover body and configured to receive a vacuum dust bag, said vacuum dust bag being connected with a dust collecting chamber disposed in a main body of the vacuum cleaner, and said dust cover body being separable from the dust collecting chamber, wherein the support part includes a pair of pivoting fixing members each having a groove therein configured to receive a fixing plate integrally fixed to an opening of the dust bag, said pivoting fixing members configured to pivot towards and away from the vacuum dust bag.

2. The dust cover of claim 1, further comprising a separating unit configured to separate the dust bag from the dust cover body.

3. The dust cover of claim 2, wherein the separating unit comprises:

a pair of connecting links integrally extended from one end of the pair of pivoting fixing members at a predetermined angle respectively; and a rotating mechanism connected with the pair of connecting links and configured to rotate the pair of pivoting fixing members in a direction away from each other.

4. The dust cover of claim 3, wherein the rotating mechanism comprises:

a pressing member hingedly connected with the pair of connecting links;

a button connected with the pressing member and configured to be pressed to linearly move the pressing member against the pair of connecting links such that the pair of connecting links rotate the pair of pivoting fixing members in the direction away from each other; and an elastic member disposed between the button and the dust cover body, and configured to provide an elastic force for returning the pressing member and the pivoting fixing members to initial positions when the button is released.

5. The dust cover of claim 1, further comprising:

a guide unit connected to the support part and configured to set an initial installation position of the vacuum dust bag.

6. The dust cover of claim 1, further comprising:

a handle disposed on an outside surface of the dust cover body and configured to remove the dust cover body from the main body of the vacuum cleaner and to carry the dust cover body.

7. A dust cover of a vacuum cleaner, comprising:

a support part installed on an inside of a dust cover body and configured to receive a vacuum dust bag, said vacuum dust bag being connected with a dust collecting chamber disposed in a main body of the vacuum cleaner, and said dust cover body being separable from the dust collecting chamber, and a guide unit connected to the support part and configured to set an initial installation position of the vacuum dust bag, wherein the guide unit comprises:

a guide panel fixed to the inside of the dust cover body at one side of the support part, and having a through hole communicating with a suction duct through which material is vacuumed from the outside; and a guide duct extended from the through hole of the guide panel, and configured to be inserted into an opening of the vacuum dust bag.

8. The dust cover of claim 7, wherein the guide duct is formed of an elastic material.

9. The dust cover of claim 1, further comprising:

a separating unit configured to separate the dust bag from the dust cover body; and a guide unit connected to the support part and configured to set an initial installation position of the vacuum dust bag.

10. The dust cover of claim 9, wherein the separating unit comprises:

a pair of connecting links integrally extended from one end of the pair of pivoting fixing members at a predetermined angle;

a pressing member pivotally connected with the pair of connecting links respectively, and configured to push the pair of connecting links to rotate the pair of pivoting fixing members away from each other;

a button connected with the pressing member, and configured to be pressed to linearly move the pressing member against the pair of connecting links such that the pair of connecting links rotate the pivoting fixing members away from each other; and an elastic member disposed between the button and the dust cover body, and configured to provide an elastic force for returning the pressing member and the fixing pivoting members to initial positions when the button is released.

11. The dust cover of claim 9, wherein the guide unit comprises:

a guide panel fixed to the inside of the dust cover body at one side of the support part, and having a through hole communicating with a suction duct through which material is vacuumed from the outside; and a guide duct extended from the through hole of the guide panel, and configured to be inserted into an opening of the vacuum dust bag.

12. The dust cover of claim 11, wherein the guide duct is formed of an elastic material.

13. A dust cover of a vacuum cleaner, comprising:

a connection duct integrally installed to a dust cover body and configured to be connected with a suction duct through which material is vacuumed; and a support part installed on one end of the connection duct and configured to receive a vacuum dust bag;

wherein the support part comprises a duct connector communicating with the connection duct and inserted into an opening of the dust bag to support the dust bag.

14. The dust cover of claim 13, wherein the connection duct is formed of an elastic material.

15. The dust cover of claim 13, further comprising:

a separating unit configured to separate the vacuum dust bag from the dust cover body.

16. The dust cover of claim 15, wherein the separating unit comprises:

a lever having a bent portion at one end thereof pivotally connected to the dust cover body, and having the other end disposed adjacent to the dust bag, wherein the lever is configured to be rotated centering on a pivot axis to push out and thus separate the vacuum dust bag.

17. The dust cover of claim 16, wherein the separating unit further comprises:

a knob extended from the lever to an exterior of the dust cover body, and configured to move the lever to separate the vacuum dust bag when the knob is rotated.

18. The dust cover of claim 17, further comprising:

an elastic member configured to return the lever to an initial position when the knob is released.

19. The dust cover of claim 16, wherein the other end of the lever adjacent to the vacuum dust bag cover is divided into at least two parts so as to be pressed toward outside edges of the vacuum dust bag.

20. The dust cover of claim 13, wherein the dust cover body and the connection duct are formed of a transparent material.

21. A dust cover of a vacuum cleaner, comprising:

a support part installed on an inner surface of a dust cover body and configured to receive a vacuum dust bag, said vacuum dust bag being elastically connected with a dust collecting chamber disposed in a main body of the vacuum cleaner;

a handle on an outside surface of the dust cover body; and a releasable coupling mechanism configured to releasably couple the dust cover body to the main body, wherein the support part comprises a pair of fixing members having grooves therein configured to receive edges of the vacuum dust bag, said fixing members being disposed substantially perpendicular to an upright axis of the vacuum cleaner such that a top portion of the vacuum dust bag is inserted into the grooves of the fixing members and a bottom portion of the vacuum dust bag hangs below the top portion due to gravity, and wherein the vacuum dust bag is supported only via the support part such that the dust cover body can be removed from the main body while the vacuum dust bag is still supported by the support part, the dust cover body can be carried to a disposal location, and the vacuum dust bag can be removed from the support part by only pulling the vacuum dust bag out of the grooves of the fixing members to thereby dispose of the vacuum dust bag, wherein the fixing members are pivoting fixing members configured to pivot towards and away from the vacuum dust bag.

22. The dust cover of claim 21, wherein the bottom portion of the vacuum dust bag hangs freely below the top portion.

23. The dust cover of claim 21, wherein the support part comprising the pair of fixing members form a shape corresponding to the top portion of the vacuum dust bag such that the vacuum dust bag is securely inserted into the grooves of the fixing members.

24. The dust cover of claim 21, further comprising:

a separating unit configured to separate the vacuum dust bag from the dust cover body, wherein the separating unit comprises:

a pair of connecting links integrally extended from one end of the pair of pivoting fixing members at a predetermined angle respectively; and a rotating mechanism connected with the pair of connecting links and configured to rotate the pair of pivoting fixing members in a direction away from each other.

25. The dust cover of claim 24, wherein the rotating mechanism comprises:

a pressing member hingedly connected with the pair of connecting links;

a button connected with the pressing member and configured to be pressed to linearly move the pressing member against the pair of connecting links such that the pair of connecting links rotate the pair of pivoting fixing members in the direction away from each other; and an elastic member disposed between the button and the dust cover, and configured to provide an elastic force for returning the pressing member and the fixing member to initial positions when the button is released.

26. The dust cover of claim 21, further comprising:

a guide unit connected to the support part and configured to set an initial installation position of the vacuum dust bag, wherein the guide unit comprises:

a guide panel hingedly fixed to one side of the support part, and having a through hole communicating with a suction duct through which material is vacuumed from the outside; and a guide duct extended from the through hole of the guide panel, and configured to be inserted into an opening of the vacuum dust bag.

* * * * *